US007423379B2

(12) United States Patent
Van Esveld et al.

(10) Patent No.: US 7,423,379 B2
(45) Date of Patent: Sep. 9, 2008

(54) HIGH-PRESSURE GAS DISCHARGE LAMP HAVING TUBULAR ELECTRODES

(75) Inventors: Hendrik Anton Van Esveld, Eindhoven (NL); Vincent Marco Fischer, Eindhoven (NL); Jeroen Waltherus Johannes Schoone, Turnhout (BE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/567,693

(22) PCT Filed: Aug. 3, 2004

(86) PCT No.: PCT/IB2004/051365

§ 371 (c)(1),
(2), (4) Date: Feb. 7, 2006

(87) PCT Pub. No.: WO2005/015603

PCT Pub. Date: Feb. 17, 2005

(65) Prior Publication Data

US 2006/0238127 A1 Oct. 26, 2006

(30) Foreign Application Priority Data

Aug. 11, 2003 (EP) ..... 03102495

(51) Int. Cl.
*H01J 61/30* (2006.01)

(52) U.S. Cl. ..... 313/627; 313/570; 313/25

(58) Field of Classification Search ..... 313/627, 313/634, 491
See application file for complete search history.

(56) References Cited

U.S. PATENT DOCUMENTS

| | | | | |
|---|---|---|---|---|
| 2,951,171 | A | 8/1960 | Holmes | |
| 3,313,980 | A | 4/1967 | Ducati | |
| 3,558,964 | A * | 1/1971 | White | 313/627 |
| 3,597,650 | A | 8/1971 | Anderson et al. | |
| 3,916,241 | A * | 10/1975 | Pollard | 313/623 |
| 4,202,999 | A * | 5/1980 | Holle et al. | 174/50.61 |
| 5,994,839 | A * | 11/1999 | Yamamoto et al. | 313/570 |

FOREIGN PATENT DOCUMENTS

| | | |
|---|---|---|
| EP | 0866488 A1 | 9/1998 |
| EP | 0866488 B1 | 9/1998 |
| GB | 663878 | 12/1951 |
| JP | 4171651 | 6/1992 |

* cited by examiner

*Primary Examiner*—Joseph Williams

(57) ABSTRACT

A high-pressure discharge lamp has a discharge vessel (10) enclosing a discharge space (11) which contains an ionizable filling. The discharge vessel has a first (2) and a second (3) mutually opposed neck-shaped portion provided with a pair of electrodes (6, 7) arranged in the discharge space (13). Each electrode is tubular over its entire length. Preferably, the electrodes are free from coils in the discharge space. Preferably, the electrodes extend to outside the discharge vessel. The high-pressure discharge lamp according to the invention is relatively easy to manufacture.

12 Claims, 3 Drawing Sheets

HIGH-PRESSURE GAS DISCHARGE LAMP HAVING TUBULAR ELECTRODES

The invention relates to a high-pressure discharge lamp.

High-pressure discharge lamps have become a dominant player in lighting retail applications, street lighting, city-beautification, beamers and projection television. Trends have emerged which create positive conditions for range extensions. End users in the market become more and more interested in a uniform quality of the light and would prefer to use high-pressure discharge lamps instead of halogen lamps for accent lighting because of their higher luminous efficacy.

Generally, high-pressure discharge lamps of the kind mentioned in the opening paragraph either have a discharge vessel with a high-temperature-resistant ceramic wall or have a quartz glass discharge vessel. Such high-pressure discharge lamps are widely used in practice and combine a high luminous efficacy with favorable color properties. The discharge vessel of the lamp contains one or several metal halides with or without Hg and a rare gas filling for use as a starting gas.

Generally speaking, the filling of the discharge vessel contains one or more metal iodides, for instance from the alkali or rare earth groups, if necessary combined with Tl, Cs, Na, Ca, etc., with which a desired value for the general color-rendering index CRI and the color temperature $T_c$ is realized. Rare-earth metals in this description and these claims are understood to mean the elements Sc, Y and the lanthanides.

A ceramic wall of a discharge vessel in the present description and claims is understood to be a wall made from one of the following materials: monocrystalline metal oxide (for example sapphire), translucent densely sintered polycrystalline metal oxide (for example $Al_2O_3$, YAG), and translucent densely sintered polycrystalline metal nitride (for example AlN).

A high-pressure discharge lamp of the type defined in the opening paragraph is known from U.S. Pat. No. 2,951,171. The known high-pressure discharge lamp comprises a translucent envelope, an inert gas filling, and a pair of axially aligned spaced, conductive electrodes within the envelope. The electrodes each have a conical depression and an axially cylindrical recess which is filled with a material with a high electron emission. The electrodes are provided with a helically coiled metal wire in contact with the wall of the recess. A disadvantage of the known high-pressure discharge lamp is that it is relatively difficult to manufacture the electrodes in the discharge lamp.

The invention has for its object to eliminate the above disadvantage wholly or partly. According to the invention, a high-pressure discharge lamp of the kind mentioned in the opening paragraph for this purpose comprises:

a discharge vessel enclosing a discharge space which contains an ionizable filling, the discharge vessel having a first and a second mutually opposed neck-shaped portion provided with a pair of electrodes arranged in the discharge space, each electrode being tubular over its entire length.

With electrodes which are tubular over their entire length, it was surprisingly observed that the starting behavior of the discharge lamps is advantageously improved. Starting of the high-pressure discharge lamp according to the invention initiates the ignition at a tip of the tubular electrode. Ignition of the known discharge lamp causes the arc to start somewhere on the electrode, usually attaching itself to a part of the electrode remote from the tip of the electrode. As the temperature in the known discharge lamp rises, the arc gradually moves towards the tip of the electrode. This movement leads to unwanted sputtering of the electrodes and reduces the lumen maintenance and/or the life time of the known discharge lamp.

In the high-pressure discharge lamp according to the invention, the arc upon its ignition extends from hole to hole in the tubular electrode. Sputtering is diminished and glow-to-arc transition effects are minimal. Not wishing to be held to any particular theory, it is believed that the hole in the tubular electrode according to the invention functions as a cathode. In addition, it is believed that the dimensions of the hole in the tubular electrode determine the cathode function, and the wall thickness of the tubular electrode determines the anode function of the high-pressure discharge lamp according to the invention.

Preferably, the tubular electrodes are made of tungsten. No additives such as Y, Rh, Dy, or Ce are necessary in principle for a good performance of the discharge lamp according to the invention. The temperature of the discharge lamp with tubular electrodes essentially made of tungsten can be satisfactorily controlled. In addition, the operating temperature of the discharge lamp with tubular electrodes of pure tungsten is approximately 100 degrees (Celsius) lower than that of the known discharge lamp. A considerable cost reduction is obtained for the discharge lamp according to the invention because the addition of the relatively expensive additives to the tungsten electrodes is no longer necessary and, in addition, a coil is no longer necessary. Preferably, the tubular electrodes are made by extrusion and sintering of tungsten.

In the known high-pressure discharge lamp, the manufacture of the electrodes is relatively difficult because the thermal contact between the coil and the electrode is difficult to control. In addition, the position of the coil with respect to the tip of the electrode is difficult to control. In particular, the wire ends of the coils influence the behavior of the electrode and, if they protrude from the electrode, the arc will attach itself to the protrusion and the coil wire will melt back because of the high temperatures reached. In addition, during life of the known discharge lamp, the coil may fuse itself to the electrode, thereby shifting the electrode behavior into an unwanted temperature region and causing a (premature) failure of the known discharge lamp or a substantial degradation of its performance. To this end an advantageous embodiment of the high-pressure discharge lamp according to the invention is characterized in that the electrodes are free from coils in the discharge space.

A preferred embodiment of the high-pressure discharge lamp according to the invention is characterized in that the electrodes extend to outside the discharge vessel. This facilitates the manufacture of the discharge lamp according to the invention. Preferably, the electrodes are partially filled with a rod welded at a side of the electrodes facing away from the discharge space. This solid rod enables an electrical connection and regulates the temperature profile of the electrode. Preferably, the rod extends into the discharge space. An advantage of a solid rod issuing from the electrode and reaching into the discharge space is that, given the same outer dimensions of the electrode, a heavier electrode is formed with a lighter tip, ignition will still be from the tip of the tubular electrode because there thermal losses will be lowest at start, and the arc will move toward the tip of the extruded rod, preventing back-arcing in undesired locations.

The new design of the electrodes in the high-pressure discharge lamp according to the invention leads to new design parameters for the shape of the discharge lamp as well as for the electrodes. Accordingly, a preferred embodiment of the high-pressure discharge lamp according to the invention is characterized in that the ratio between the inner diameter $d_{in}$ and the outer diameter $d_{out}$ of the electrodes is in the range:

$$0.2 \leq \frac{d_{in}}{d_{out}} \leq 0.8.$$

Either the wall or the hole has to act as a cathode. By way of example, a tubular electrode with a diameter of 1000 μm with a inner diameter of 350 μm has a suitable wall thickness of 350 μm. If the inner diameter is 100 μm, the wall thickness will be 450 μm. If the inner diameter is 800 μm, the wall thickness will be 100 μm.

Sample tubular electrodes have been made and tried out in 250 W Ceramic Discharge Metal halide lamps, the so-called CDM lamps. Experiments have shown that the high-pressure discharge lamp provided with the tubular electrodes according to the invention performed as expected. In particular, all discharge lamps ignited on the tip of the electrode. In addition, re-ignition spikes were low and ignition and take-over went smoothly. In addition, a high-pressure discharge lamp with a tubular electrode according to the invention was operated under steady-state conditions at a relatively low current of 1.3 A instead of the normal 2.5 A It was found that the discharge lamp performed adequately under such conditions. Observations of burning discharge lamps led to the conclusion that the arc is on the tip of the electrode in the anode phase and moves to the inner side of the wall in the cathode phase.

These and other aspects of the invention are apparent from and will be elucidated with reference to the embodiments described hereinafter.

In the drawings.

The Figures are purely diagrammatic and not drawn to scale. Notably, some dimensions are shown in a strongly exaggerated form for the sake of clarity. Similar components in the Figures are denoted as much as possible by the same reference numerals.

Figure 1A:
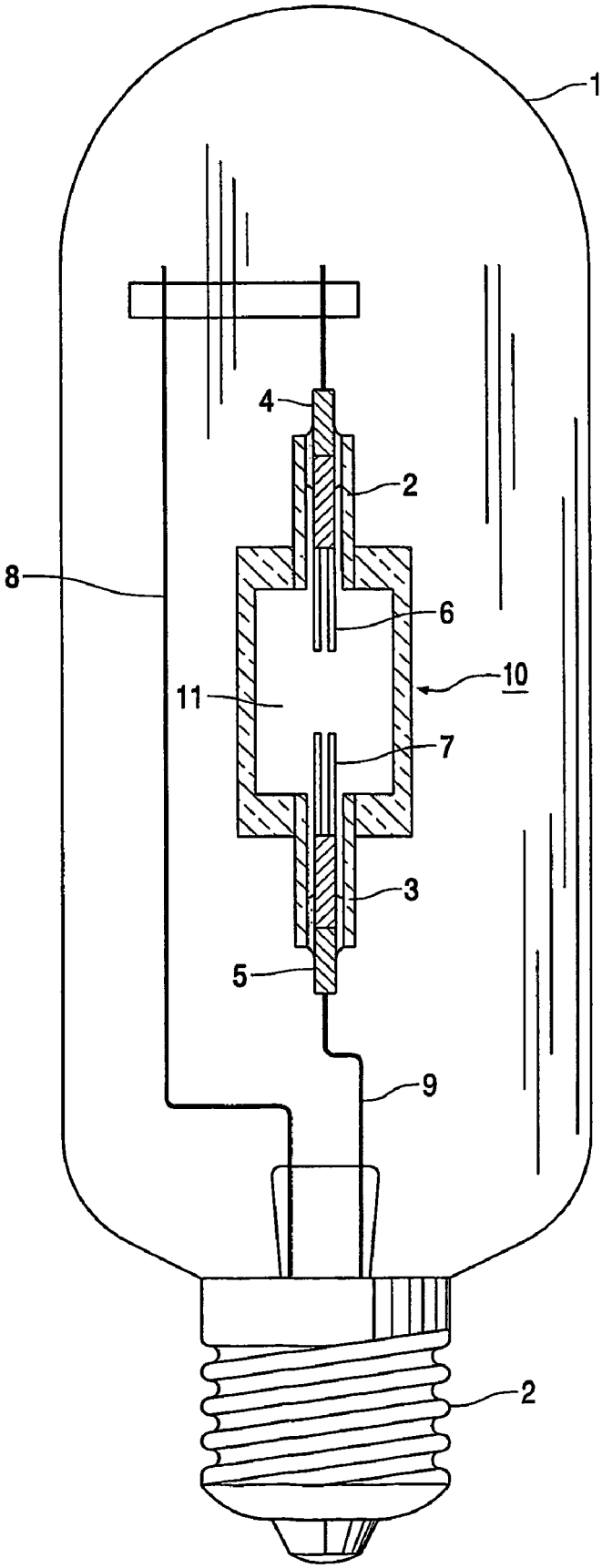
FIG. 1A shows an embodiment of the high-pressure discharge lamp according to the invention.

FIG. 1A very schematically shows a high-pressure discharge lamp according to the invention with a cut-away view of a discharge vessel 10. The discharge vessel 10 has a ceramic wall which encloses a discharge space 11. The discharge space 11 contains an ionizable filling which in the case shown contains not only Hg, but also halides of Na, Ca, and Tl. The discharge vessel 10 is provided with a first neck-shaped portion 2 and a second neck-shaped portion 3 through which a first current-supply conductor 4 and a second current-supply conductor 5, respectively, extend to a pair of electrodes 6, 7 arranged in the discharge space 11. Each electrode 6, 7 is comprised of tungsten (W) and is tubular over its entire length. The construction of the discharge vessel is known per se.

In the example of FIG. 1A, the discharge vessel is surrounded at one end by an outer bulb 1 having a lamp base 2. There is a discharge between the electrodes 6, 7 when the high-pressure discharge lamp is in operation. Electrode 6 is connected via a conductor 8 to a first electrical contact which forms part of the lamp base 2. Electrode 7 is connected via a conductor 9 to a second electrical contact which forms part of the lamp base 2. In the example of FIG. 1A, the electrodes are without coils in the discharge space. This has the advantage that the manufacture of the electrodes is relatively simple. In addition, there are no problems of the coil possibly fusing to the electrode during life of the known discharge lamp, thereby shifting the electrode behavior into an unwanted temperature region and causing (premature) failure of the known discharge lamp or a substantial degradation of its performance.

In a practical embodiment of a high-pressure discharge lamp according to the invention as shown in the drawing, the nominal power of the lamp is 70 W and the lamp has a nominal lamp voltage of 90 V. The translucent wall of the discharge vessel has a thickness of approximately 0.8 mm. The inner diameter of the discharge vessel is approximately 6.85 mm, the distance between the electrode tips is approximately 7 mm. In the example of FIG. 1, the ionizable filling of the lamp contains 4.6 mg Hg, 7 mg (Na+Tl+Ca) iodide having a molar percentage composition of 64 mole % Na, 5 mole % Tl and 31 mole % Ca of the total molar quantity of the iodides. The discharge vessel also contains Ar as a start enhancer with a filling pressure of 300 mbar. During operation of the lamp, $T_{kp}$ is 1265 K. The lamp emits light with a luminous efficacy of 90 lm/W for 100 hours. The color temperature $T_c$ of the emitted light is 3150K. The general color rendering index $R_a$ is approximately 90.

Figure 1B:
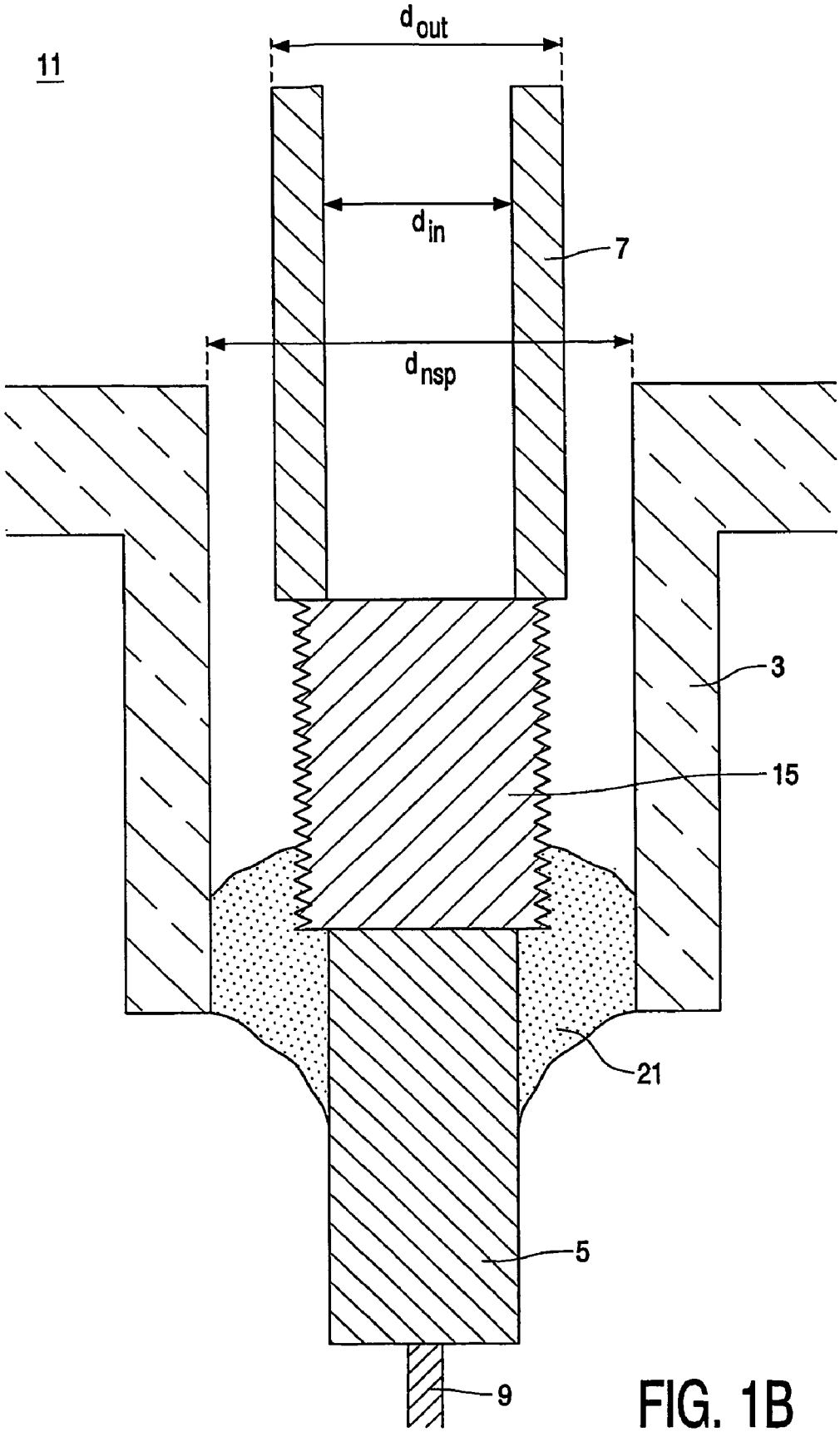
FIG. 1B shows a detail of the high-pressure discharge lamp as shown in FIG. 1A.

FIG. 1B schematically shows a cross-sectional view of a detail of the high-pressure discharge lamp as shown in FIG. 1A. Only the second neck-shaped portion referenced 3 is shown, through which the second current-supply conductor 5 extends to a tubular electrode 7 arranged in the discharge space 11. Preferably, the current-supply conductor 5 is made of niobium. In between the current-supply conductor 5 and the tubular electrode 7, a rod 15 of molybdenum or a cermet is provided. The neck-shaped portion 3 closely surrounds the tubular electrode 5 and the Mo rod 15 with clearance. A melting-ceramic joint 21 is provided between the current-supply conductor 5, the Mo rod 15 and the wall of the neck-shaped portion 3, thereby providing a gas-tight closure of the discharge space 13 in the discharge vessel 10.

Figure 2:
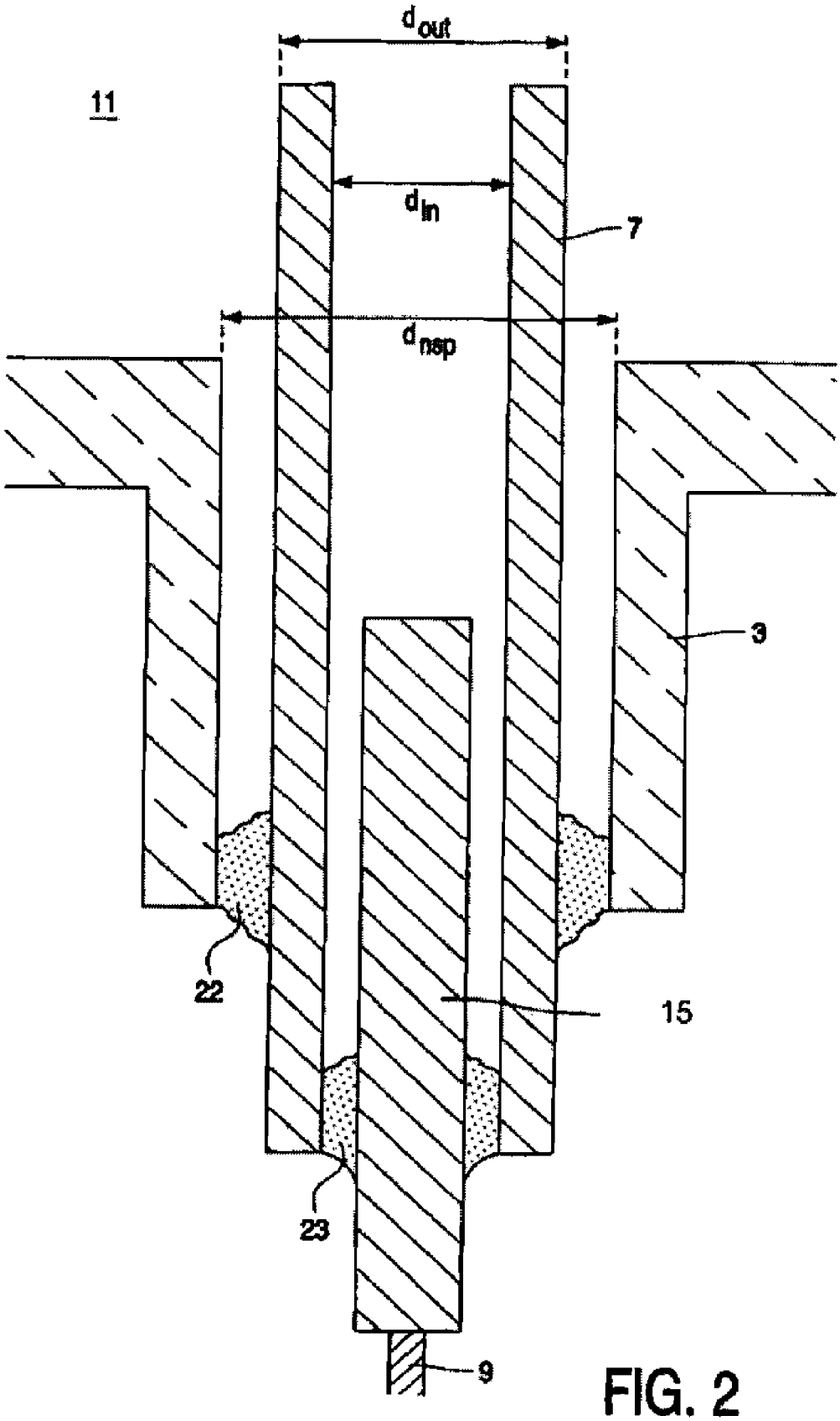
FIG. 2 shows an alternative embodiment of the high-pressure discharge lamp according to the invention.

FIG. 2 schematically shows an alternative embodiment of the high-pressure discharge lamp according to the invention. Only the second neck-shaped portion referenced 3 is shown. In this embodiment of the high-pressure discharge lamp according to the invention the electrode 7 extends to outside the discharge vessel 10. In addition, the electrode 7 is partially filled with a rod 15 welded to a side of the electrode 7 facing away from the discharge space 13 in the embodiment of FIG. 2. The solid rod 15 is preferably made of Mo, W, or Rh. Molybdenum is a very suitable material because it is cheap and has an excellent resistance to the iodide atmosphere in the discharge vessel.

In an alternative embodiment of the high-pressure discharge lamp according to the invention (not shown in FIG. 2), the rod 15 extends into the discharge space 13. In a further alterative embodiment (not shown in FIG. 2), the rod 15 in the discharge space 13 protrudes from the tubular electrode 7.

The novel design of the electrodes in the high-pressure discharge lamp according to the invention leads to new design parameters for the shape of the discharge lamp as well as for the electrodes. In FIGS. 1B and 2, the inner diameter $d_{in}$ and the outer diameter $d_{out}$ of the tubular electrode 7 are also indicated. In addition, the inner diameter $d_{nsp}$ of the neck-shaped portion 3 is also indicated in FIGS. 1B and 2 Preferably, the ratio between the inner diameter $d_{in}$ and the outer diameter $d_{out}$ of the electrodes 6, 7 is in the range:

$$0.2 \leq \frac{d_{in}}{d_{out}} \leq 0.8.$$

Preferably, the inner diameter of the tubular electrodes 6, 7 is at least 20 μm. A different favorable lower limit for the inner diameter is 50 μm.

Since no coil is to be attached to the tubular electrode 7, the diameter of the neck-shaped portion 3, 4 can now be substantially smaller in the known high-pressure discharge lamp. There has to be a clearance between the parts of the electrode (not only the part made of tungsten but also the part made of molybdenum) and the inner wall of the neck-shaped part of the burner (also called the "vup"). This clearance is determined by the thermal expansion coefficients and technical tolerances. Since the rod and coil have to pass through the neck-shaped portion 3, 4, the inner diameter of the neck-shaped portion 3, 4 is greater than necessary and is normally filled for the most part by the molybdenum feed-through. The profit arises from the fact that, if the hole in the neck-shaped portion can be made substantially smaller than in the known discharge lamp, also the volume which is filled with salt is substantially reduced. Preferably, the ratio of the outer diameter $d_{out}$ of the tubular electrodes 6,7 to the inner diameter $d_{nsp}$ of the neck-shaped portions 3, 4 is in the range:

$$0.8 \leq \frac{d_{out}}{d_{nsp}} \leq 0.95.$$

An advantage of a smaller neck-shaped portion 3, 4 is that less salt can be used in the high-pressure discharge lamps. In particular, an advantageous reduction of up to 80% of the salt content in the discharge vessel 10 can be realized.

A preferred embodiment of the high-pressure discharge lamp according to the invention is characterized in that the ratio between the electric current $I_{mhl}$ of the high-pressure discharge lamp and the outer diameter $d_{out}$ of the electrodes 6, 7 is in the range:

$$2 \leq \frac{I_{mhl}}{d_{out}^2 - d_{in}^2} \leq 6,$$

In the above formula, the electric current is expressed in ampere and the diameter in millimeters. Not wishing to be held to any particular theory it is assumed that the power $P_{anode}$ to the anode phase governing the temperature of the electrode tip is determined by:

$$P_{anode} = I \times [V_{anode} + \text{work function}]$$

(for example 4.5 eV for tungsten). The size of the known electrode rods is governed by the power in the anode phase. The temperature of the tip of the electrode can be calculated assuming the same current density, taking an upper limit of 3200 K and a lower limit of 2200 K. In this manner the above-mentioned relationship is obtained for the ratio between the electric current $I_{mhl}$ of the high-pressure discharge lamp and the outer diameter $d_{out}$ of the electrodes 6, 7.

By way of example for a high-pressure discharge lamp of 250 W, a suitable outer diameter $d_{out}$ of the tubular electrode is approximately 680 μm. A suitable thickness of the wall of the tubular electrode is approximately 140 μm. A suitable inner diameter $d_{nsp}$ of the neck-shaped portions 3, 4 would be in a range from approximately 830 to 880 μm. A conventional rod electrode for a known 250 W high-pressure discharge lamp with similar wattage would have a diameter of approximately 800 μm. A coil with wire thickness of 250 μm would normally be wound around the rod, giving a total diameter of rod and coil of 1300 μm. This would normally require an inner diameter $d_{nsp}$ of the neck-shaped portion of approximately 1500 μm. The reduction in salt for the discharge lamp according to the invention compared with he known discharge lamp is in a range from 50 to 70%.

Another example of a high-pressure discharge lamp of 70 W has a suitable outer diameter $d_{out}$ of the tubular electrode of approximately 415 μm. A suitable thickness of the wall of the tubular electrode is approximately 85 μm. A suitable inner diameter $d_{nsp}$ of the neck-shaped portions 3, 4 would be approximately 550 μm. A conventional rod electrode for a known 70 W high-pressure discharge lamp with similar wattage would have a diameter of approximately 300 μm. A coil with wire thickness of 170 μm would normally be wound around the rod, giving a total diameter of rod and coil of 650 μm. This would normally require an inner diameter $d_{nsp}$ of the neck-shaped portion of approximately 775 μm. The reduction in salt for the discharge lamp according to the invention compared with the known discharge lamp is in a range from 30 to 50%.

Yet another example of a high-pressure discharge lamp of 35 W has a suitable outer diameter $d_{out}$ of the tubular electrode of approximately 300 μm. A suitable thickness of the wall of the tubular electrode is approximately 60 μm. A suitable inner diameter $d_{nsp}$ of the neck-shaped portions 3, 4 would be approximately 435 μm. A conventional rod electrode for a known 35 W high-pressure discharge lamp with similar wattage would have a diameter of approximately 200 μm. A coil with wire thickness of 125 μm would normally be wound around the rod, giving a total diameter of rod and coil of 450 μm. This would normally require an inner diameter $d_{nsp}$ of the neck-shaped portion of approximately 585 μm. The reduction in salt for the discharge lamp according to the invention compared with the known discharge lamp is in a range from 30 to 50%.

Generally speaking, practically all known high-pressure discharge lamps have electrodes in the typical form of a tungsten rod with a tungsten coil wound around it. The coil is either welded or clamped on the rod. The coil has a large influence on the starting behavior and on the cathode phase in the steady state (re-ignition peaks). The coil enhances ignition and take-over by providing a spot where the arc can easily attach itself to the coil. It is believed that the enhancement is due to three factors. At ignition, deformities give a distortion of the electric field, which facilitates ignition in combination with charges on the wall. Secondly, the coil reaches a high temperature faster than the rod due to a low mass and lower heat conductivity (contact from the coil to the rod is a point-line contact, i.e. with high thermal resistance). Thirdly, the arc seems to attach in between two turns of the coil.

A number of drawbacks of the existing rod+coil configurations has been found. One difficulty is how to make a reproducible electrode because the thermal contact between coil and rod and the position of the coil with respect to the tip of the rod are variables that are difficult to control. In addition, the wire ends of the coil influence the electrode behavior and if they protrude from the rod the arc will attach itself there and the coil wire will melt back because of the high temperatures reached. During life, the coil may fuse itself to the rod, shifting the electrode behavior into an unwanted temperature region, which will cause failure of the lamp or degrade its performance significantly.

According to the present invention, a tube-like electrode made of tungsten is used. The hole in the tube functions as a cathode, so in principle this is an electrode made of one piece where the dimension of the hole determines the cathode function and the amount of tungsten per millimeter determines the anode function. An additional advantage is found in starting of the high-pressure discharge lamp, because ignition will now go from the tip of one electrode to the tip of the adjacent electrode. It is observed that the arc attaches itself to the hole of the tubular electrode and not somewhere else on the electrode. In this manner arc attachment does not move during run-up but provides power to the top only, as is indeed desired. In the high-pressure discharge lamp according to the invention, sputtering is largely diminished and glow-to-arc transitions are minimized, which has a beneficial effect on life and maintenance of the discharge lamp according to the invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A high-pressure discharge lamp comprising: a discharge vessel (10) enclosing a discharge space (11) which contains an ionizable filling, the discharge vessel (10) having a first (2) and a second (3) mutually opposed neck-shaped portion provided with a pair of electrodes (6, 7) protruding substantially into the discharge space (11), each electrode (6, 7) being tubular over its entire length, at least one of the electrodes (6, 7) being directly coupled at an end not arranged in the discharge space, to a rod (15) which is coupled at a distal end to a current-supply conductor (5), a melting-ceramic joint (21) being provided between the current-supply conductor (5), the rod (15) and a wall of the respective first (2) and a second (3) mutually opposed neck-shaped portions, thereby providing a gas-tight closure of the discharge space.

2. A high-pressure discharge lamp as claimed in claim 1, wherein the electrodes (6, 7) are free from coils in the discharge space (11).

3. A high-pressure discharge lamp as claimed in claim 1, wherein the electrodes (6, 7) extend to outside the discharge vessel (10).

4. A high-pressure discharge lamp as claimed in claim 3, wherein the electrodes (6, 7) are each partially filled with a rod (15) welded to a side of the electrodes (6, 7) facing away from the discharge space (11).

5. A high-pressure discharge lamp as claimed in claim 4, characterized in that the rod (15) extends into the discharge space (11).

6. A high-pressure discharge lamp as claimed in claim 1, wherein the ratio between the inner diameter $d_{in}$ and the outer diameter $d_{out}$ of the electrodes (6, 7) is in the range:

$$0.2 < \frac{d_{in}}{d_{out}} < 0.8.$$

7. A high-pressure discharge lamp as claimed in claim 1, wherein the inner diameter of the tubular electrodes (6, 7) is at least 20 μm.

8. A high-pressure discharge lamp as claimed in claim 2, wherein the ratio of the outer diameter $d_{out}$ of the tubular electrodes (6, 7) and the inner diameter $d_{nsp}$ of the neck-shaped portions (2, 3) is in the range:

$$0.2 < \frac{d_{out}}{d_{nsp}} < 0.8.$$

9. A high-pressure discharge lamp as claimed in claim 1, wherein the electrodes (6, 7) are made of tungsten.

10. A high-pressure discharge lamp as claimed in claim 1, wherein the ratio between the electric current $I_{mhl}$ of the high-pressure discharge lamp and the outer diameter $d_{out}$ of the electrodes (6, 7) is in the range:

$$2 < \frac{I_{mhl}}{\left(\frac{d_{out}^2}{d_{in}^2}\right)} < 6,$$

wherein the electric current is expressed in amperes and the diameter in millimeters.

11. A high-pressure discharge lamp as claimed in claim 1, wherein the rod (15) is made from one of molybdenum or cermet.

12. A high-pressure discharge lamp as claimed in claim 1, wherein the current-supply conductor (5) is made from niobium.

* * * * *